US005850875A

United States Patent [19]

McCulloch et al.

[11] Patent Number: 5,850,875

[45] Date of Patent: Dec. 22, 1998

[54] METHOD OF DEPLOYING A WELL SCREEN AND ASSOCIATED APPARATUS THEREFOR

[75] Inventors: Derek J. McCulloch, Banchory, Scotland; Colby M. Ross, Carrollton, Tex.

[73] Assignee: Halliburton Energy Services, Inc., Dallas, Tex.

[21] Appl. No.: 777,493

[22] Filed: Dec. 30, 1996

[51] Int. Cl.[6] ..... E21B 43/12

[52] U.S. Cl. ..... 166/380; 166/205

[58] Field of Search ..... 166/380, 382, 166/278, 51, 117, 169, 205, 227, 242.6

[56] References Cited

U.S. PATENT DOCUMENTS 5,295,538 3/1994 Restarick ..... 166/205
5,377,750 1/1995 Aterbury et al. ..... 166/205
5,390,742 2/1995 Dines et al. ..... 166/297
5,579,844 12/1996 Rebardi et al. ..... 166/205 X

*Primary Examiner*—William P. Neuder
*Attorney, Agent, or Firm*—Paul I. Herman; Marlin R. Smith

[57] ABSTRACT

A method of deploying a well screen and associated apparatus provide convenient and economical completion operations within subterranean wells. In a disclosed embodiment, a method of positioning a screen includes attaching the screen to a completion string before stimulation operations are performed on a formation. Initially, the screen is spaced apart from the formation. After the stimulation operations are performed, the screen is positioned opposite the formation and packers are set above and below the screen. In order to thus position the screen, a work string is inserted into the completion string, the screen is attached to the work string, and the screen is released from the completion string. After the packers are set, the work string may be retrieved and the formation placed in production. The screen and packers prevent flow of particulate material from the formation into the completion string. Other methods are provided as well.

58 Claims, 8 Drawing Sheets

METHOD OF DEPLOYING A WELL SCREEN AND ASSOCIATED APPARATUS THEREFOR

BACKGROUND OF THE INVENTION

The present invention relates generally to operations performed within a subterranean wellbore and, in a preferred embodiment thereof, more particularly provides a method of deploying a well screen and associated apparatus for such deployment.

In well stimulation operations, solid materials are frequently pumped into a formation intersected by the well in order to prop open fractures formed in the formation. The solid materials are known as "proppants" and may be sand, synthetic materials, etc.

Ideally, all of the material pumped into the formation remains in the formation when fluids are produced therefrom. In actuality, however, some of the material flows back into the wellbore and is produced along with the formation fluids. This proppant "flowback" causes a series of problems in production, maintenance, and economics of the well.

When the proppant flowback is produced along with the formation fluids, it must be separated from the formation fluids at the production facility, typically at the earth's surface or on an offshore production platform. This operation requires special equipment to screen, remove, and dispose of the proppant. Environmental concerns make disposal of the proppant difficult, or at least expensive.

As the proppant flows through production equipment, both downhole and at the surface, the proppant continually erodes the equipment. This erosion makes costly and time-consuming replacement of the equipment necessary.

In recent years, the problems with proppant flowback have increased. Larger and more numerous fractures are being formed in formations due to technological advances in the fracturing art. On average, more proppants are being forced into the fractures as well.

Several solutions have been proposed for the proppant flowback problem. Of these, some propose to treat the formation with chemicals, such as resins, thermosetting plastic films, other inert netting materials, etc. These chemical solutions have met with only limited success.

Another solution involves positioning a tubular well screen opposite the formation after it has been stimulated. The screen prevents the proppant from being produced with the formation fluids and, thereby, prevents the resultant erosion, disposal, and handling problems associated therewith. Unfortunately, where a completion string is disposed within the well, and it is subsequently desired to position the screen below the completion string, the screen must be run into the well through the interior of the completion string, or the completion string must be pulled, the screen attached thereto, and the completion string repositioned within the well, with the screen suspended therefrom.

If the screen is run into the well through the interior of the completion string, the screen's outer diameter must necessarily be smaller than the completion string's inner diameter. This severely restricts the choice of screens and may prevent the screen design from being optimized for the particular production characteristics of the well. As a general rule, larger screens have less flow restriction and are, therefore, preferred over smaller screens.

Conventional gravel packing screens and equipment are normally run as an integral part of some completions. This practice, however, precludes the use of this equipment in wells that require high rate proppant fracturing treatments.

For one to achieve the desired objectives of high rate fracturing treatments along with the use of conventional screens and gravel packing equipment, the well would have to be fractured first, then the screens and/or other gravel packing equipment would have to be installed conventionally with an additional run of the completion string. This additional run to install the gravel packing equipment is both time-consuming and costly.

If the screen is suspended from the completion string, time-consuming and costly removal of the completion string is required. In addition, the well must be killed while the completion string is pulled and reinstalled. Such killing of the well after it has been stimulated will frequently cause damage to the formation's potential productivity.

In some cases, the formation pore pressure is close to the fracture gradient, and if the well is killed while the completion string is removed therefrom, significant fluid loss into the formation will result. Completion fluids, such as very heavily weighted brines, are extremely expensive, and their loss should be prevented, if possible.

From the foregoing, it can be seen that it would be quite desirable to provide a method of deploying a well screen which does not require the screen to be run through a completion string, thereby enabling the completion string to remain nippled up, and which does not require killing the well, but which enables the screen to be optimally selected for the particular well production characteristics, and prevents loss of completion fluids into the formation. Additionally, it is desirable to provide a method whereby the screen may be deployed as part of a gravel pack assembly, so that the formation may be gravel packed after stimulation, without the necessity of killing the well. It would also be desirable to provide a method which allows the installation of conventional gravel pack equipment in wells not requiring high rate proppant fracturing treatments, without the necessity of applying an overbalance well control fluid, especially in high pressure and high temperature wells that require sand control or gravel packing and where the formation pore pressure is very close to the fracture gradient and well control is a primary consideration. It is accordingly an object of the present invention to provide such a method and associated apparatus.

SUMMARY OF THE INVENTION

In carrying out the principles of the present invention, in accordance with an embodiment thereof, a method of positioning a screen within a well is provided which enables the screen to be initially disposed in a first position, and subsequently disposed in a second position, utilization of which does not hinder other operations in the well, does not require killing the well, and does not require a completion string to be removed from the well. In one disclosed embodiment, the screen is initially suspended from the completion string, thereby maintaining the screen spaced away from a formation, and a work string is then installed through the completion string, latching the screen onto the work string and releasing it from the completion string, enabling the screen to be positioned opposite the formation by the work string. Packers disposed above and below the screen are then set and the work string is removed from the well, permitting production of fluid from the formation, with any proppant flowback being prevented by the screen.

In broad terms, a method of positioning a screen within a subterranean wellbore is provided which includes the steps of disposing the screen at a first axial position within the well, installing a first string of tubing within the well, installing a second string of tubing within the first string of tubing, and attaching the screen to the second string of tubing. The screen may be released from the first string of tubing, and then the second string of tubing may be used to reposition the screen in the wellbore.

In another aspect of the present invention, a method of deploying a screen within a subterranean well is provided where the well has a wellbore intersecting a formation. The method includes the steps of positioning the screen within the wellbore axially spaced apart from the formation, stimulating the formation, and positioning the screen opposite the formation after the step of stimulating the formation. By positioning the screen opposite the formation after it has been stimulated, the screen does not interfere with the stimulation operation.

Another method is provided by the present invention. For completing a subterranean well having a wellbore intersecting a formation, the method includes the steps of providing a screen assembly including a first packer and a generally tubular screen having opposite ends, the first packer being attached to one of the screen opposite ends, disposing the screen assembly within the wellbore axially spaced apart from the formation, installing a first tubing string into the wellbore, and attaching the screen assembly to the first tubing string after the step of disposing the screen assembly within the wellbore. In one disclosed embodiment, the screen assembly is placed in the bottom of the wellbore and a second tubing string is installed in the wellbore prior to the first tubing string being installed therein. A second packer may be attached to the other end of the screen.

In yet another aspect of the present invention, a method of completing a subterranean well having a wellbore intersecting a formation is provided. The method includes the steps of disposing a generally tubular screen within the wellbore axially spaced apart from the formation, forcing fluid into the formation after the step of disposing the screen within the wellbore, and positioning the screen opposite the formation, thereby forming an annular space between the screen and the formation, after the step of forcing fluid into the formation. When fluid is later produced from the formation, any particulate matter, such as sand, proppant, gravel, etc., which is produced along with the fluid, will accumulate in the annular space between the screen and the formation.

Also provided by the present invention is a method of deploying a screen in a subterranean well. The method includes the steps of releasably attaching the screen to a first tubing string, disposing the first tubing string within the well, disposing a second tubing string within the well, attaching the screen to the second tubing string, and releasing the screen from the first tubing string. In this manner, the screen may be initially positioned relative to the first tubing string and then positioned relative to a second tubing string, the second tubing string being used to displace the screen within the well.

In still another aspect of the present invention, apparatus for attachment to a tubing string within a subterranean well is provided. The apparatus includes a screen, a packer, and a latch structure. The screen is generally tubular and has opposite ends. The packer is attached to one of the screen opposite ends. The latch structure is attached to the packer, and is capable of being attached to the tubing string within the well. Thus, the screen is positionable within the well by displacing the tubing string after the latch structure has been attached to the tubing string.

Apparatus for positioning equipment within a subterranean well is provided, as well. The apparatus includes first and second portions. The first portion is configured for attachment to the equipment, and the second portion is complementarily shaped relative to the first portion. The second portion is configured for operative engagement with the first portion to thereby permit displacement of the equipment within the well by displacement of the second portion.

Additionally, apparatus for positioning equipment within a subterranean well relative to first and second tubing strings disposed therein is provided by the present invention. The apparatus includes first, second, and third portions. The first portion is attachable to the equipment. The second portion is attachable to the first tubing string and is releasably attachable to the first portion. The third portion is attachable to the second tubing string and is attachable to the first portion.

Initially, the first portion is attached to the equipment and to the second portion, which, in turn, is attached to the first tubing string. This assembly is then positioned in the well. When it is desired to reposition the equipment in the well, the third portion is attached to the second tubing string and installed in the well, such that the third portion attaches to the first portion, and the first portion releases from the second portion.

The use of the disclosed methods and apparatus permits more economical and efficient completion of wells. In particular, where there is a danger of particulate matter in a formation being produced along with fluids therefrom, the disclosed methods provide convenient removal of the particulate matter from the fluids. Additionally, the disclosed apparatus provide convenient repositioning of equipment within a wellbore.

DETAILED DESCRIPTION

Figure 1A:
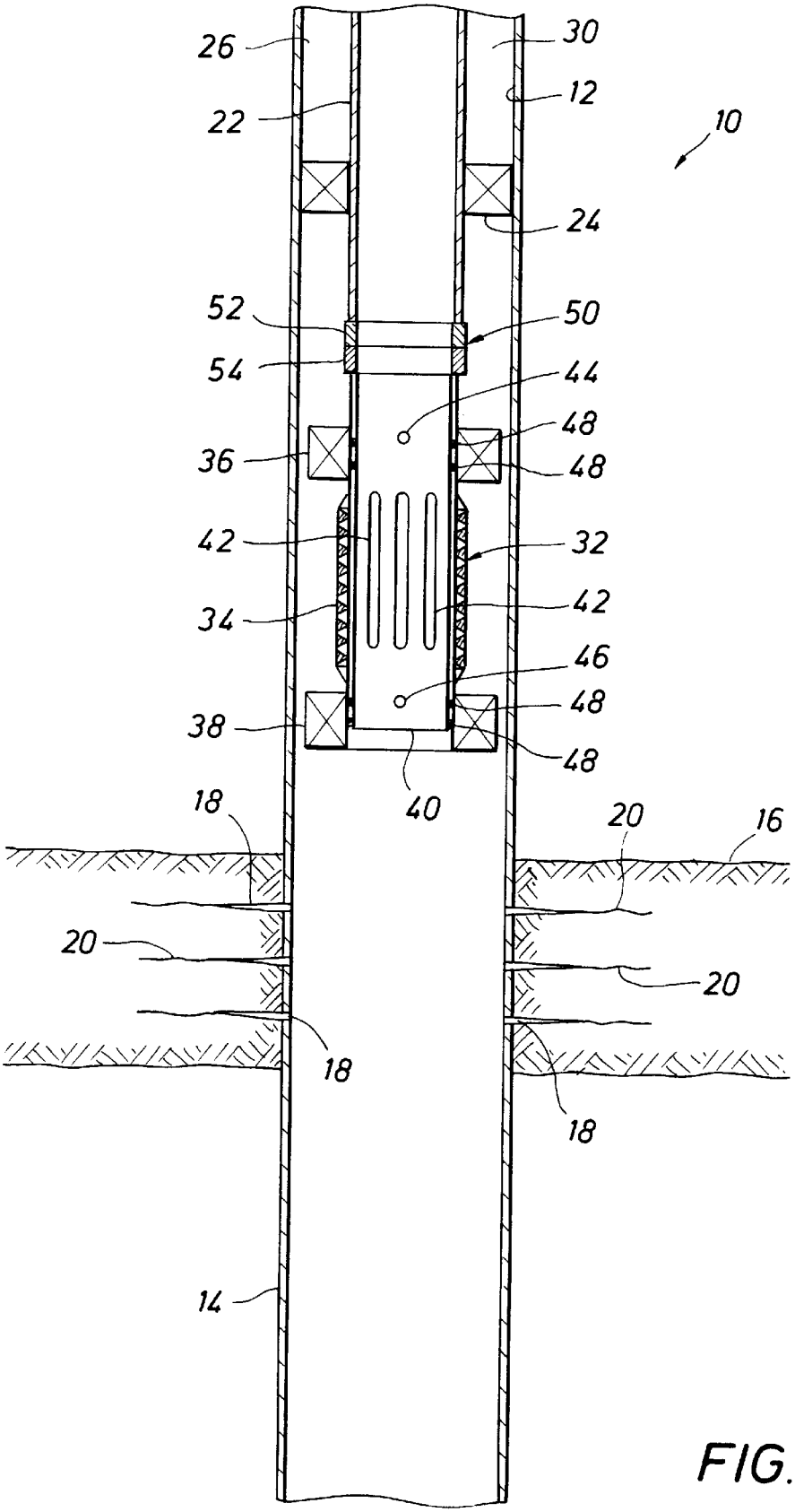
FIGS. 1A & 1B are schematic cross-sectional views of a first method embodying principles of the present invention.
Figure 1B:
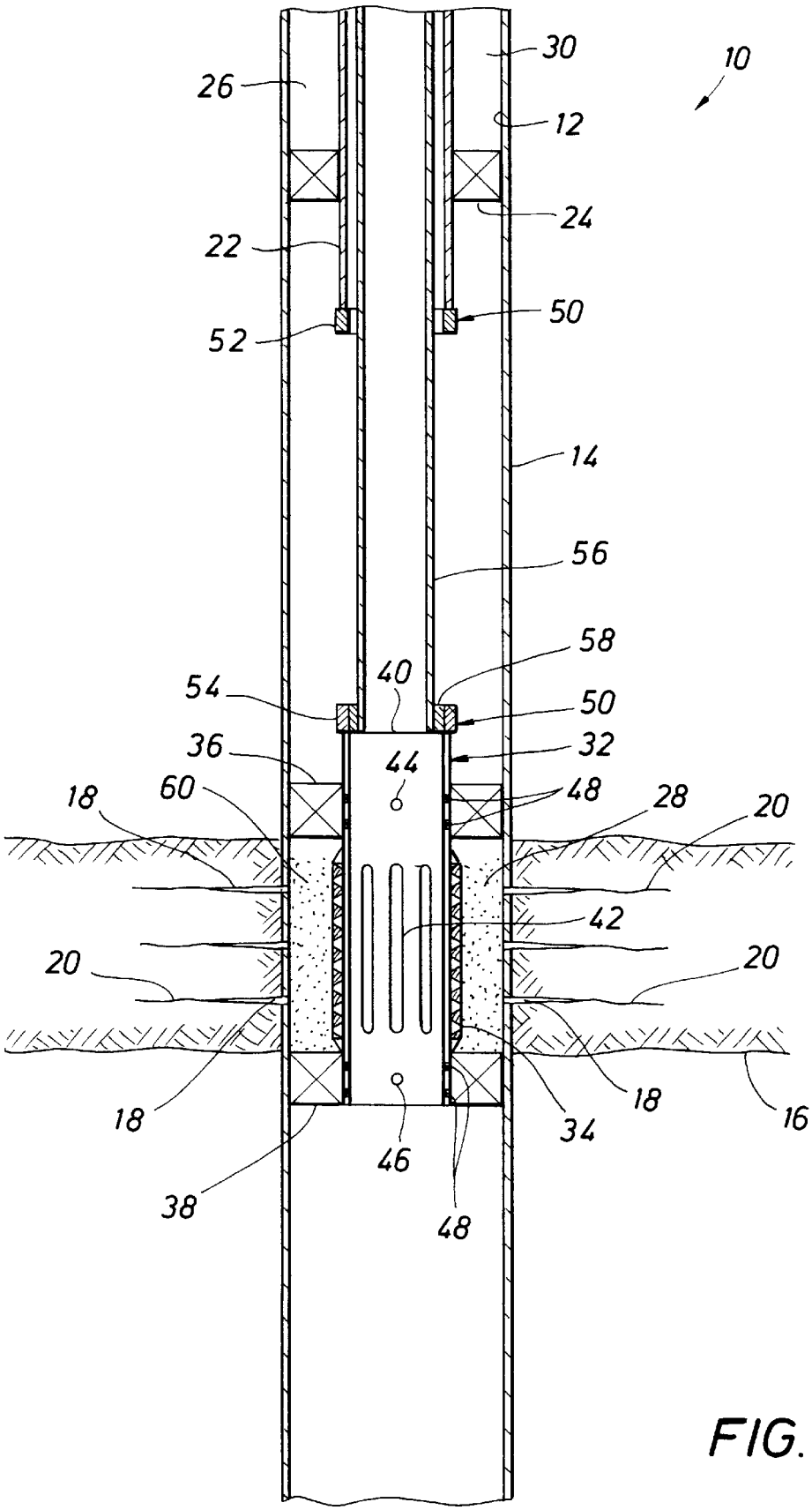

Representatively illustrated in FIGS. 1A & 1B is a method of deploying a well screen 10 which embodies principles of the present invention. The method 10 is performed within a subterranean well, which includes a wellbore 12 lined with protective casing 14. In the illustrated method 10, the depicted casing 14 may also be a liner, etc., but it is to be understood that it is not necessary for the wellbore 12 to be lined or cased according to the principles of the present invention.

As representatively illustrated in FIGS. 1A & 1B, the wellbore 12 is generally vertically disposed. However, it is to be understood that the method 10, and other methods and apparatus described hereinbelow, may be performed or utilized in horizontal, inclined, inverted, and otherwise disposed wellbores without departing from the principles of the present invention. For convenience of description, directional terms, such as "upper", "lower", "above", "below", "upward", "downward", etc., are used herein to refer to the methods and apparatus as they are depicted in the accompanying figures.

The wellbore 12 intersects a formation 16 below the earth's surface. As used herein, the term "formation" is used to refer to a strata, or an interval thereof, intersected by the wellbore 12. Perforations 18 are formed radially outward through the casing 14 and into the formation 16 to thereby permit fluid communication between the wellbore 12 and the formation.

Fractures 20 are formed in the formation 16 by conventional methods, such as by forcing pressurized fluid through a completion tubing string 22 from the earth's surface, through the perforations 18, and into the formation. The illustrated fractures 20 are of the type known as cleat type fractures associated with fracturing of coal beds, but it is to be understood that the fractures 20 may be otherwise formed without departing from the principles of the present invention. A packer 24 isolates an upper annulus 26 between the completion string 22 and the casing 14 from fluid communication with the wellbore 12 below the packer 24. Proppant 28 is carried into the fractures 20 as the fracturing fluid is forced into the formation 16.

Thus, as viewed in FIG. 1A, the formation 16 has been perforated and fractured, with proppant 28 (not visible in FIG. 1A, see FIG. 1B) disposed in the fractures 20. Other stimulation operations, such as acidizing, may also have been performed on the formation 16. For convenient control of the well, the completion string 22 is preferably nippled up at the earth's surface and weighted fluid 30 may be contained in the annulus 26.

It will be apparent to one of ordinary skill in the art that, if the formation 16 is produced by flowing fluid from the formation into the wellbore 12, and then through the completion string 22 to the earth's surface, it is quite possible that a portion of the proppant 28 will be carried along with the fluid. Alternatively, or in addition, other particulate material, such as sand, may be flowed from the formation 16 into the wellbore 12.

If the completion string 22 is retrieved from the wellbore 12 in order to permit installation of a suitably configured screen opposite the formation 16, the effort will be not only time-consuming and, therefore, expensive, it will also require that the sealing engagement of the packer 24 between the completion string and the casing 14 be broken. When this sealing engagement is broken, the weighted fluid 30 is permitted to flow into the formation 16 through the perforations 18, thereby wasting the fluid. In many cases, the fluid 30 is very costly, making such retrieval of the completion string 22 uneconomical.

If a screen is run through the completion string 22 from the earth's surface to the wellbore 12 opposite the formation 16, the screen must have an external dimension that is smaller than the internal dimension of the completion string. Thus, by running the screen through the completion string after the stimulation operation, the size of the screen is severely limited, thereby preventing optimization of the screen design.

To prevent proppant flowback, or to otherwise prevent particulate material from being produced along with fluid from the formation 16, and to enable optimization of the screen design. The method 10 includes attaching a screen assembly 32 to the completion string 22. As viewed in FIG. 1A, the screen assembly 32 is axially spaced apart from the formation 16 (or, at least spaced apart from the perforations 18) initially, so that the screen assembly does not interfere with the stimulation operations.

The screen assembly 32 includes a generally tubular well screen 34, an upper packer 36, and a lower packer 38. In the representatively illustrated method 10, the packers 36, 38 are of the type which are settable by applying fluid pressure to ports (not visible in FIG. 1A) formed internally therein. This type of packer is well known to those of ordinary skill in the art as hydraulically-settable. It is to be understood, however, that other types of packers, such as mechanically-settable, cup-type, etc., may be utilized in the method 10 without departing from the principles of the present invention. Additionally, the screen 34 is representatively and schematically illustrated as being of the type well known to those of ordinary skill in the art as a wire-wrapped screen, but it is to be understood that other types of screens, such as sintered metal, etc., may be utilized in the method 10 without departing from the principles of the present invention.

To prevent premature setting of the packers 36, 38 due to fluid pressure in the wellbore 12, an isolation sleeve 40 is disposed within the screen assembly 32. The isolation sleeve 40 is generally tubular and is axially slidingly disposed internally within the screen 34 and the packers 36, 38. A series of elongated slots 42 are formed through the isolation sleeve 40 to provide for fluid communication radially through the screen 34. An upper opening 44 and a lower opening 46 are formed through the isolation sleeve 40 to selectively permit fluid communication between the wellbore 12 and the internal ports on the packers 36, 38.

As representatively illustrated in FIG. 1A, the internal ports on the packers 36, 38 are isolated from fluid communication with the wellbore 12, due to sealing engagement of circumferential seals 48 between the isolation sleeve 40 and each of the packers. The openings 44, 46 are axially upwardly disposed relative to each of the respective internal ports of the packers 36, 38, and the seals 48 axially straddle the internal ports. Thus, in its axially upwardly disposed configuration as viewed in FIG. 1A, the isolation sleeve 40 prevents fluid pressure in the wellbore 12 from entering the internal ports of the packers 36, 38, and, thus prevents setting of the packers. Of course, if one (or both) of the packers 36, 38 is not of the hydraulically-settable type, such fluid isolation will correspondingly not be appropriate for that packer.

The screen assembly 32 is releasably attached to the completion string 22 by means of an apparatus 50. The apparatus 50 has a generally tubular first portion 52 secured to the completion string 22, and a second portion 54 secured to the screen assembly 32. As viewed in FIG. 1A, the screen assembly 32 is, thus, suspended from the completion string 22 by releasable attachment of the first portion 52 to the second portion 54. Preferably, the screen assembly 32 is releasably attached to the completion string 22, utilizing the apparatus 50, before the completion string 22 is installed in the well.

In this manner, the screen assembly 32 is positioned within the wellbore 12 spaced apart from the formation 16 before the stimulation operations are performed. Thereafter, the screen assembly 32 may be repositioned within the wellbore 12 without running the screen 34 through the completion string 22, without breaking the sealing engagement of the packer 24 between the casing 14 and the completion string 22, and permitting the completion string to remain nippled up at the earth's surface.

To reposition the screen assembly 32, a tubular work string 56 (see FIG. 1B) is inserted into the completion string 22 at the earth's surface. A generally tubular third portion 58 of the apparatus 50 is secured to the work string 56. The third portion 58 is capable of being releasably attached to the second portion 54, thereby permitting releasable attachment of the work string 56 to the screen assembly 32.

When the third portion 58 is attached to the second portion 54, such as by being latched thereto, the second portion 54 may be detached or released from the first portion. For example, a downwardly biasing force may be applied to the work string 56 after the third portion 58 has engaged the second portion 54 to thereby break shear pins (not shown in FIG. 1B) holding the first and second portions together. Such downwardly biasing force may be applied by slacking off on the work string 56 at the earth's surface to apply all or a portion of the work string's weight and release the first and second portions 52, 54 for relative axial displacement therebetween.

With the second and third portions 54, 58 operatively engaged, displacement of the work string 56 may be utilized to axially reposition the screen assembly 32 within the wellbore 12. The work string 56 may be a string of tubular sections, coiled tubing, etc., without departing from the principles of the present invention. It will be readily apparent to one of ordinary skill in the art that, with the second portion 54 attached to the third portion 58, the screen assembly 32 may be positioned within the wellbore 12, without requiring any displacement of the completion string 22.

As viewed in FIG. 1B, the screen assembly 32 has been positioned radially opposite the formation 16 after stimulation operations therein have been completed. The screen 34 is now positioned opposite the perforations 18.

The isolation sleeve 40 has been axially downwardly displaced so that the openings 44, 46 now permit fluid communication between the wellbore 12 and the internal ports of the packers 36, 38. Preferably, the isolation sleeve 40 is axially downwardly displaced as the third portion 58 engages the second portion 54. The third portion 58 axially engages the isolation sleeve 40 and displaces it axially downward as the third portion is inserted axially into the second portion 54.

The packers 36, 38 are set by applying fluid pressure to the completion string 22 at the earth's surface. Of course, if one or both of the packers 36, 38 are otherwise-settable, they may be set in another manner. For example, if the packer 36 is mechanically-settable, it may be set by manipulation of the work string 56 at the earth's surface.

With the packers 36, 38 set in the casing 14, the work string 56 may be withdrawn from the well by releasing the third portion 58 from the second portion 54. For example, if the second and third portions 54, 58 are threadedly engaged utilizing left-handed threads (not shown in FIG. 1B), the work string 56 may be detached from the screen assembly 32 by rotating the work string to the right (clockwise as viewed from above). Alternatively, a conventional slickline shifting tool could be utilized to shift a sleeve maintaining collets in engagement between the second and third portions 54, 58.

When the work string 56 is retrieved from the wellbore 12, the full interior of the completion string 22 is otherwise available for production of fluids from the formation 16 to the earth's surface. Fluid may be flowed from the formation 16, through the perforations 18, inward through the screen 34, through the completion string 22, and to the earth's surface. Particulate material, such as proppant 28, sand, gravel, etc., is filtered out of the fluid by the screen 34 and accumulates in an annular space 60 formed radially between the screen and the formation 16, and axially between the packers 36, 38.

Thus, the particulate material is prevented from entering the completion string 22. Equipment in the completion string 22 and at the earth's surface is protected from erosion. There is no need to dispose of the material at the earth's surface. The material does not clog chokes, etc. The weighted fluid 30 is preserved. The completion string 22 remains nippled up during and after the stimulation operations. These and other benefits are achieved by use of the method 10 as representatively illustrated and described hereinabove.

Figure 2A:
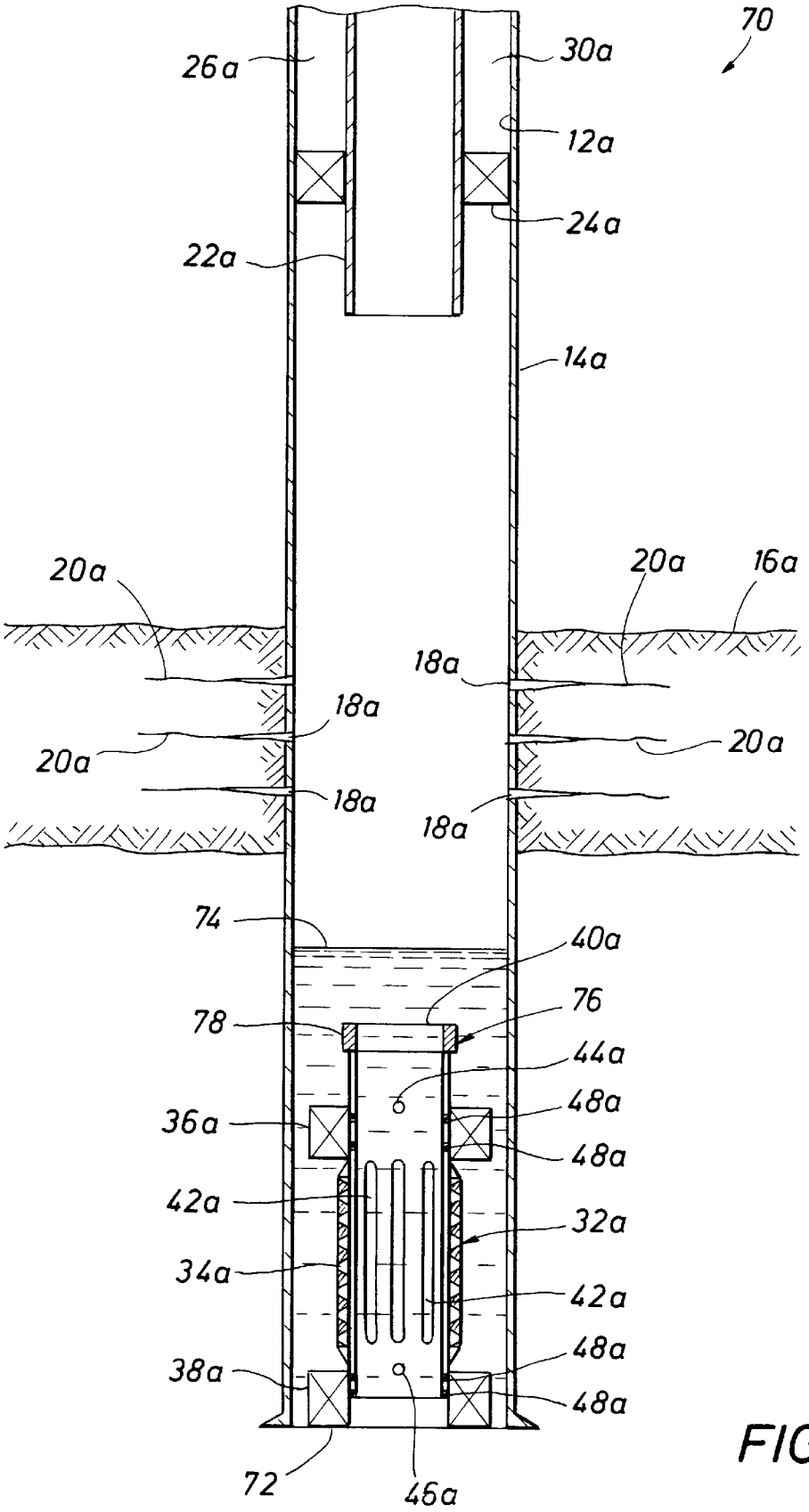
FIGS. 2A & 2B are schematic cross-sectional views of a second method embodying principles of the present invention.
Figure 2B:
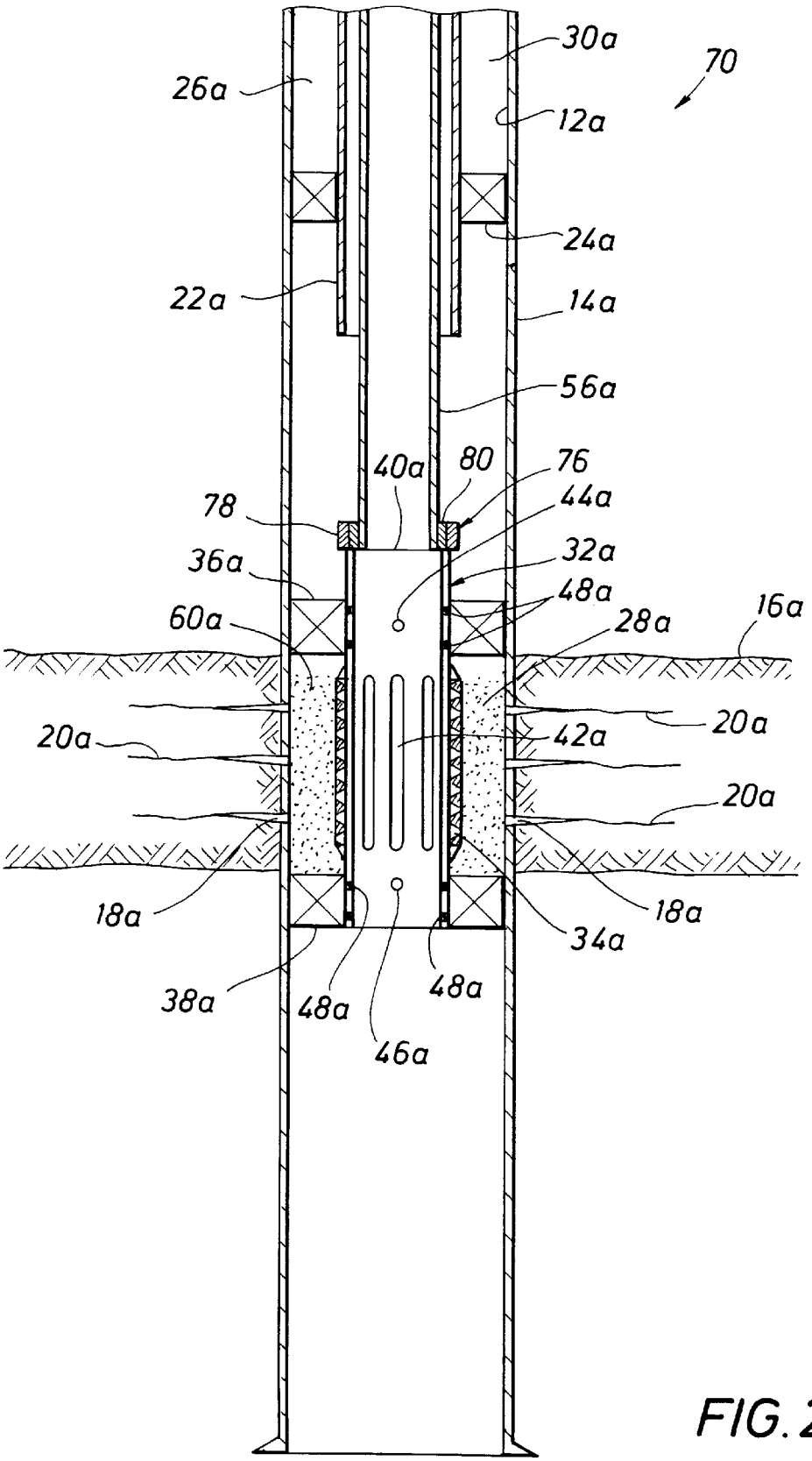

Referring additionally now to FIGS. 2A & 2B, another method 70 embodying principles of the present invention is representatively and schematically illustrated. Elements shown in FIGS. 2A and 2B which are similar to elements previously described herein are indicated in FIGS. 2A and 2B using the same reference numerals, with an added suffix "a".

As viewed in FIG. 2A, the screen assembly 32*a* is initially disposed within the wellbore 12*a* spaced apart from the formation 16*a*, but, unlike the method 10, the screen assembly is not initially attached to the completion string 22*a*. Instead, the screen assembly 32*a* is positioned proximate a bottom 72 of the wellbore 12*a*. Alternatively, the screen assembly 32*a* could be landed in another position in the wellbore 12*a*, for example, by utilizing a conventional landing nipple, no-go, etc.

With the screen assembly 32*a* positioned proximate the bottom 72, the completion string 22*a* may be run into the well, nippled up, and stimulation operations may be performed on the formation 16*a*. To prevent proppant 28*a* and/or debris from accumulating about the screen assembly 32*a*, a conventional gel 74 may be spotted around the screen assembly to thereby form a protective barrier between the screen assembly and the formation 16*a*.

As with the method 10, the isolation sleeve 40*a* initially prevents fluid communication between the wellbore 12*a* and the internal ports on the packers 36*a*, 38*a*. In its axially upwardly disposed configuration as viewed in FIG. 2A, the seals 48*a* axially straddle each of the corresponding internal ports on the packers 36*a*, 38*a*. The isolation sleeve 40 may, however, be axially downwardly displaced to thereby permit fluid communication between the wellbore 12*a* and the internal ports of the packers 36*a*, 38*a*, via the respective openings 44*a*, 46*a*.

FIG. 2B representatively illustrates the screen assembly 32*a* deployed within the wellbore 12*a* so that it is now positioned opposite the formation 16*a*. To achieve this deployment of the screen assembly 32*a*, the workstring 56*a* is inserted into the completion string 22*a* at the earth's surface. Fluid may be circulated through the work string 56*a* as it nears the screen assembly 32*a* in order to remove the gel 74 therefrom in a conventional manner.

The work string 56*a* is then releasably attached to the screen assembly 32*a* by means of an apparatus 76. The apparatus 76 includes a first portion 78 secured to the screen assembly 32*a*, and a second portion 80 secured to the work string 56*a*. When the work string 56*a* is inserted sufficiently into the wellbore 12*a*, the first portion 78 operatively engages the second portion 80, for example, by latching therewith.

With the work string 56*a* releasably attached to the screen assembly 32*a* as shown in FIG. 2B, the screen assembly may be displaced axially within the wellbore 12*a* by displacement of the workstring. As with engagement of the second and third portions 54, 58 of the apparatus 50, engagement of the first and second portions 78, 80 of the apparatus 76 preferably causes the isolation sleeve 40*a* to downwardly displace, permitting fluid communication between the wellbore 12*a* and the internal ports of the packers 36*a*, 38*a*.

The packers 36*a,* 38*a* are then set so that they axially straddle the perforations 18*a.* The screen 34*a* is thereby positioned radially opposite the formation 16*a,* forming the annular space 60*a* therebetween. When fluid is flowed from the formation 16*a*, through the perforations 18*a,* and through the screen 34*a,* the particulate material accumulates in the annular space 60*a.*

Note that, before the fluid is flowed from the formation 16*a*, the work string 56*a* may be retrieved from the wellbore 12*a* by releasing the first portion 78 from the second portion 80 of the apparatus 76. Such detaching of the first and second portions 78, 80 may be accomplished by, for example, rotating the workstring at the earth's surface, shifting a sleeve within the apparatus 76, etc.

Figure 3A:
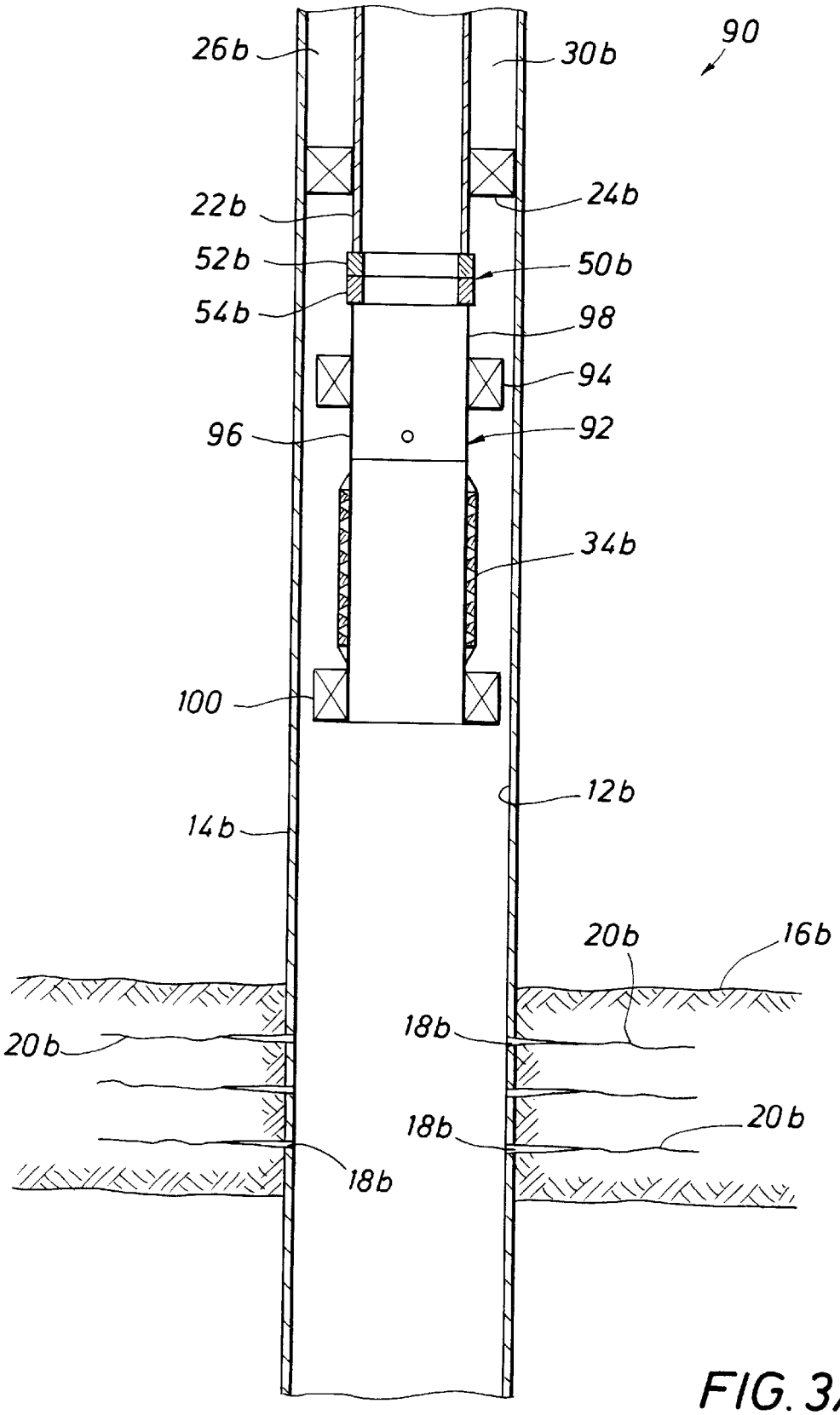
FIGS. 3A & 3B are schematic cross-sectional views of a third method embodying principles of the present invention.
Figure 3B:
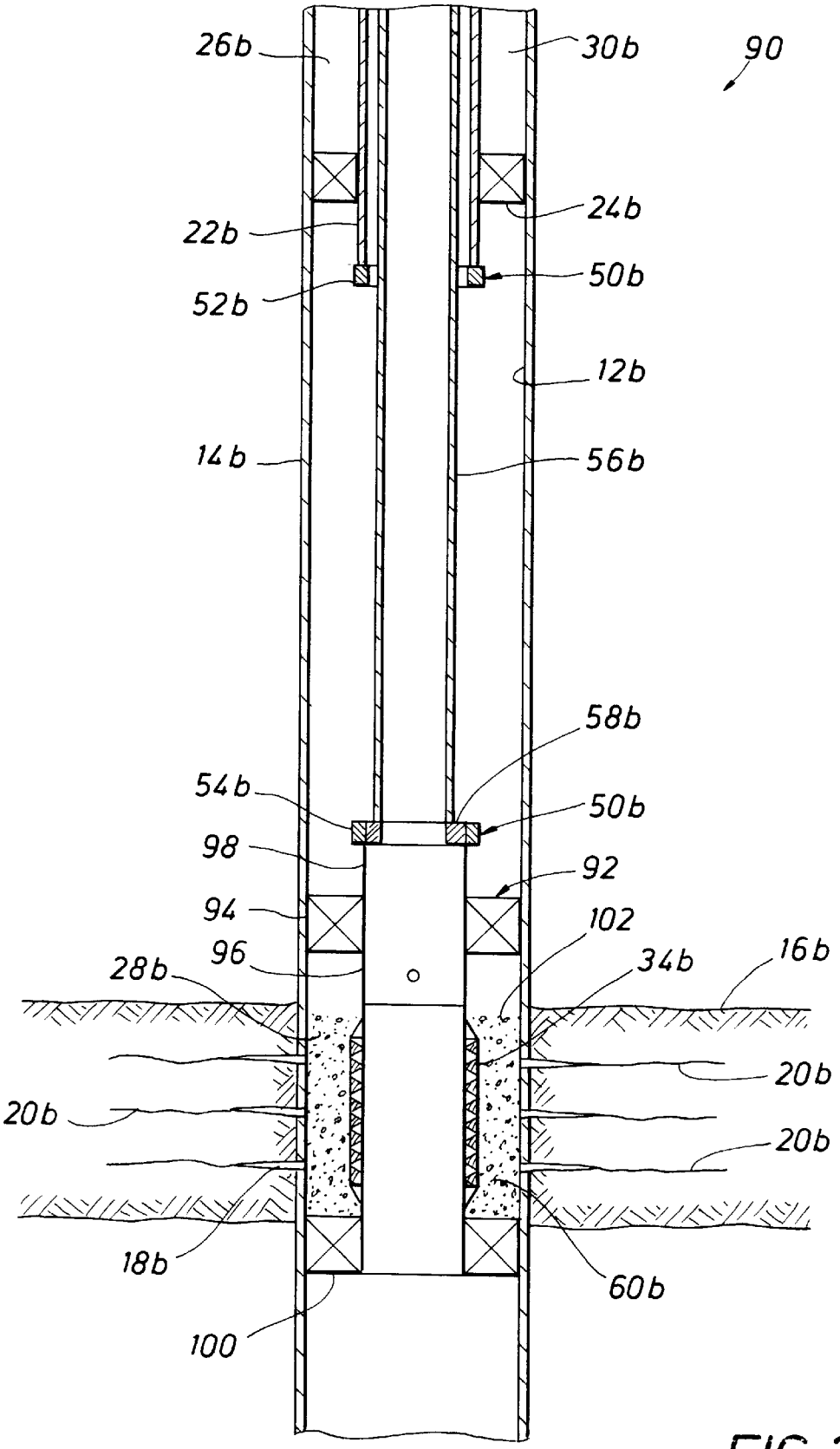

Referring additionally now to FIGS. 3A & 3B, another method 90 embodying principles of the present invention is representatively and schematically illustrated. Elements shown in FIGS. 3A & 3B which are similar to elements previously described are indicated in FIGS. 3A & 3B using the same reference numerals, with an added suffix "b".

In the method 90, a gravel packing assembly 92 is releasably attached to the completion string 22*b* in a manner similar to the releasable attachment of the screen assembly 32 to the completion string 22 in the method 10. The gravel packing assembly 92 includes the screen 34*b*, a gravel packing packer 94, crossover 96, service tool 98, and sump packer 100. These items of gravel packing equipment are well known to those of ordinary skill in the art. For example, the service tool 98 may be an MPT tool and the gravel packing packer may be a Versa-Trieve® packer, both of which are manufactured by, and available from, Halliburton Energy Services of Duncan, Okla.

As with the screen assembly 32, the gravel packing assembly 92 is initially disposed axially spaced apart from the formation 16*b* as shown in FIG. 3A. Stimulation operations, such as high flow rate proppant fracturing operations may, thus, be performed on the formation 16*b* without danger of eroding the gravel packing equipment, such as the crossover 96. When such high flow rate proppant fracturing operations are performed with gravel packing equipment positioned opposite the formation, it is quite common for items of the gravel packing equipment to be eroded thereby.

In FIG. 3B, the gravel packing assembly 92 is shown repositioned opposite the formation 16*b* after the stimulation operations have been performed. The packers 94, 100 have been set in the wellbore 12*b* and a conventional gravel packing operation has been performed, gravel 102 having been deposited in the annular space 60*b* between the screen 34*b* and the formation 16*b.*

The gravel packing assembly 92 is repositioned by inserting the work string 56*b* into the completion string 22*b* and releasably attaching the third portion 58*b* of the apparatus 50*b* to the second portion 54*b.* The second portion 54*b* is then detached from the first portion 52*b* secured to the completion string 22*b*. In the method 90, the second portion is secured to the gravel packing assembly 92, so that the work string 56*b* may be utilized to displace the gravel packing assembly within the wellbore 12*b*. Engagement of the work string 56*b* with the gravel packing assembly 92 also permits flowing of gravel 102 from the earth's surface through the work string to the annular space 60*b,* and manipulation of the service tool 98 by movement of the work string.

With the gravel packing assembly 92 positioned as shown in FIG. 3B, the screen 34*b* is opposite the formation 16*b* and the packers 94, 100 are set in the wellbore 12*b,* forming the annular space 60*b*. When fluid is subsequently flowed from the formation 16*b* and through the screen 34*b*, the gravel 102, proppant 28*b,* and any other particulate matter is prevented from passing inwardly through the screen. As described above for the methods 10, 70, the work string 56*b* may be retrieved from the wellbore 12*b* prior to production of fluids from the formation 16*b* by releasing the second portion 54*b* from the third portion 58*b.*

Figure 4A:
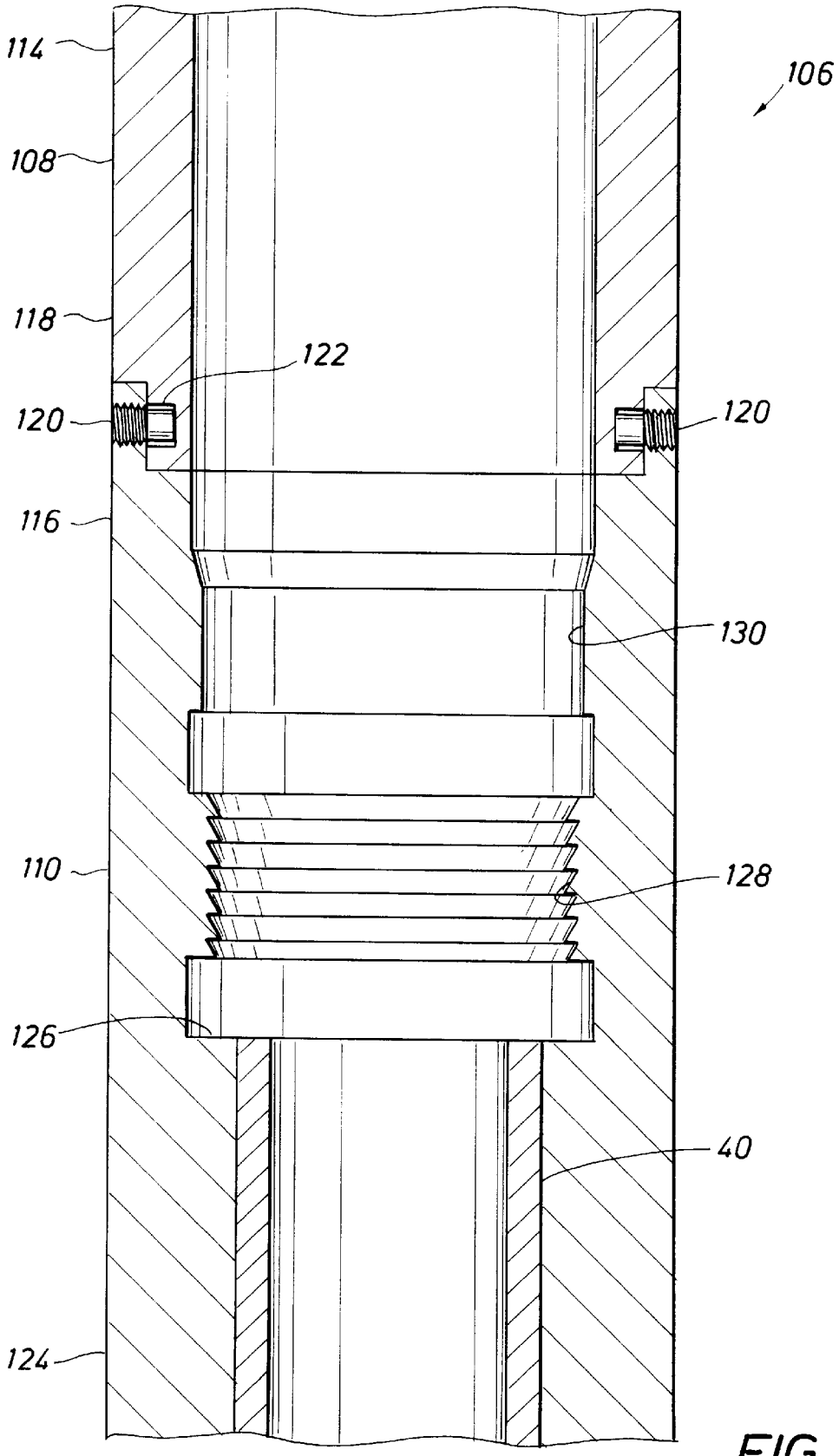
FIGS. 4A & 4B are schematic cross-sectional views of an apparatus embodying principles of the present invention.
Figure 4B:
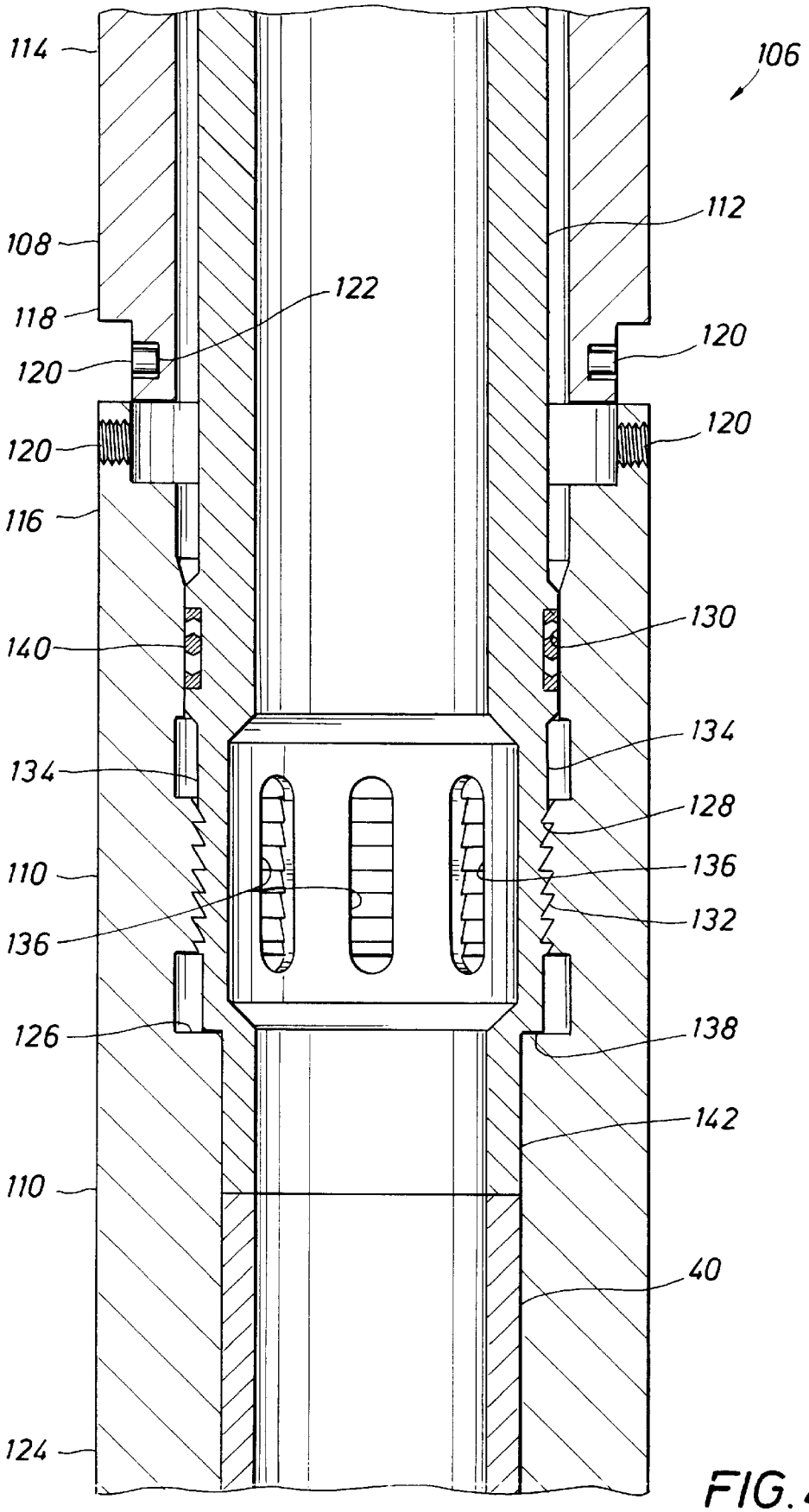

Referring additionally now to FIGS. 4A & 4B, an apparatus 106 embodying principles of the present invention is schematically and representatively illustrated. The apparatus 106 may be utilized for the previously described apparatus 50 and, with suitable modification, for the apparatus 76. For convenience of description, the apparatus 106 is described hereinbelow as if it is utilized for the apparatus 50 in the method 10 representatively illustrated in FIGS. 1A & 1B.

The apparatus 106 includes generally tubular first, second, and third portions 108, 110, and 112, respectively. These may correspond with respective ones of the first, second, and third portions 52, 54, and 58 representatively illustrated in FIGS. 1A & 1B. The first portion 108 is attachable to the completion string 22 at its upper end 114 by, for example, being threadedly connected thereto. The first portion 108 is releasably attachable to an upper end 116 of the second portion 110 at its lower end 118 by means of shear screws 120 threadedly installed laterally through the upper end 116 and into a circumferential groove 122 formed exteriorly on the lower end 118. It is to be understood that other means of releasably attaching or latching the first portion 108 to the second portion 110 may be utilized without departing from the principles of the present invention, for example, a series of circumferentially spaced apart collets formed on one of the first and second portions could engage a recess formed on the other one of them, etc.

When used in the method 10, the isolation sleeve 40 extends upwardly within a lower end 124 of the second portion 110. The second portion 110 is attached to the screen assembly 32 at its lower end 124 by, for example, being threadedly connected thereto. As representatively illustrated in FIGS. 4A & 4B, the isolation sleeve 40 extends to a position adjacent an upwardly facing shoulder 126 formed internally on the second portion 110. Above the shoulder 126, the second portion 110 is internally threaded, and above the threads 128 an axially extending seal bore 130 is internally formed.

The threads 128 are of the type known to those skilled in the art as left-handed buttress threads. Each of the threads 128 has an upwardly facing inclined face and a flat, or laterally disposed, downwardly facing face. The threads 128 are utilized in the apparatus 106 to both permit latching of the third portion 112 to the second portion 110 as more fully described below, to axially engage the second and third portions so that the second portion may be transported within the wellbore 12 by displacement of the third portion, for example, by manipulation of the work string 56 at the earth's surface, and to permit the third portion to be released from the second portion. It is to be understood that other means of engaging, latching, releasably attaching, etc., the second portion 110 to the third portion 112 may be utilized without departing from the principles of the present invention, for example, a configuration similar to the RATCH-LATCH® manufactured by, and available from, the Halliburton Company of Duncan, Okla., or a mechanism similar that commonly used on lock mandrels, etc.

In the method 10, the third portion 112 is attached to the work string 56 and inserted downwardly through the completion string 22. When the third portion 112 reaches the first and second portions 108, 110, the third portion passes axially through the first portion, but it engages the second portion. Left-handed buttress threads 132, which are complementarily shaped relative to threads 128, and which are externally formed on axially extending and inwardly deflectable fingers 134, axially engage the threads 128. The mating inclined faces permit the fingers 134 to inwardly deflect while the threads 132 displace downwardly relative to the threads 128. The fingers 134 are separated by a series of axially extending and circumferentially spaced apart elongated slots 136 formed through the third portion 112.

Eventually, a downwardly facing shoulder 138 exteriorly formed on the third portion 112 axially contacts the internal shoulder 126. Such axial contact between the shoulders 126, 138 prevents further axially downward displacement of the third portion 112 relative to the second portion 110. Additionally, at this point, a circumferential seal, such as packing 140, sealingly engages the seal bore 130, and a downwardly extending lower end 142 of the third portion 112 has axially engaged and downwardly displaced the isolation sleeve 40, thereby placing the isolation sleeve in its downwardly disposed position in the method 10 representatively illustrated in FIG. 1B. Thus, the third portion 112 has latched onto, sealingly engaged, abutted, and axially engaged the second portion 110 as shown in FIG. 4B.

To release the second portion 110 from the first portion 108, the third portion 112 is forced axially downward by, for example, slacking off on the work string 56 at the earth's surface. This axially downwardly directed force is transferred from the third portion 112 to the second portion 110 by the contact between the shoulders 126, 138. When sufficient force has been applied, the screws 120 shear, thereby permitting the second portion 110 to displace axially downward relative to the first portion 108.

As representatively illustrated in FIG. 4B, the screws 120 have been sheared and the second portion 110 may now be transported within the wellbore 12 by displacement of the third portion 112. When it is desired to release the third portion 112 from the second portion 110, such as, after the packers 36, 38 have been set in the method 10 as shown in FIG. 1B, the work string 56 may be rotated to the right (clockwise when viewed from above) to cause the threads 132 to unscrew from the threads 128. To assist in this operation, it is helpful to apply a slight upwardly directed force to the third portion 112, by, for example, picking up on the work string 56 at the earth's surface, while the work string is being rotated to the right. When the threads 128, 132 have disengaged, the work string 56 may be removed from the wellbore 112.

Note that the apparatus 106 is useful in methods other than method 10. For example, the second portion 110 may be utilized for the first portion 78, and the third portion 112 may be utilized for the second portion 80, of the apparatus 76 used in the method 70 representatively illustrated in FIGS. 2A &2B. Of course, suitable modifications may be made to the apparatus 106 without departing from the principles of the present invention. For example, in the method 90, the downwardly extending lower end 142 may not be needed to displace an isolation sleeve 40, the seal 140 and seal bore 130 may not be needed in the method 70, etc. These and other additions, modifications, substitutions, etc., to the apparatus 106, within the skill of those ordinarily skilled in the art, are within the principles of the present invention.

The foregoing detailed description is to be clearly understood as being given by way of illustration and example only, the spirit and scope of the present invention being limited solely by the appended claims.

What is claimed is:

1. A method of positioning a screen within a subterranean well, the method comprising the steps of:

disposing the screen at a first axial position within the well;

installing a first string of tubing within the well;

installing a second string of tubing within the first string of tubing; and attaching the screen to the second string of tubing.

2. The method according to claim 1, further comprising the step of disposing the screen at a second axial position within the well after the step of attaching the screen to the second string of tubing.

3. The method according to claim 1, further comprising the step of attaching a packer to the screen.

4. The method according to claim 3, wherein the step of attaching the packer comprises providing the packer having a port formed thereon for fluid communication to set the packer.

5. The method according to claim 4, further comprising the steps of providing a flow blocking member, and disposing the blocking member relative to the port to thereby prevent fluid communication therethrough.

6. The method according to claim 5, further comprising the step of displacing the blocking member relative to the port to thereby permit fluid communication therethrough.

7. The method according to claim 5, wherein the step of attaching the screen to the second string of tubing further comprises displacing the blocking member relative to the port.

8. The method according to claim 1, wherein the step of disposing the screen at the first axial position is performed after the step of installing the first string of tubing.

9. The method according to claim 1, wherein the step of installing the first string of tubing is performed after the step of disposing the screen at the first axial position.

10. The method according to claim 1, further comprising the step of attaching the screen to the first string of tubing.

11. The method according to claim 10, wherein the step of attaching the screen to the first string of tubing is performed before the step of installing the first string of tubing within the well.

12. The method according to claim 1, further comprising the step of attaching two packers to opposite ends of the screen, each of the packers being attached to one of the screen opposite ends.

13. The method according to claim 12, further comprising the step of setting the packers in the well.

14. The method according to claim 13, wherein the step of setting the packers further comprises setting the packers axially straddling an interval of a formation intersected by the well.

15. The method according to claim 13, wherein the first axial position is axially spaced apart from an interval of a formation intersected by the well, and further comprising the step of disposing the packer at a second axial position opposite the formation before performing the step of setting the packers.

16. A method of deploying a screen within a subterranean well, the well having a wellbore intersecting a formation, the method comprising the steps of:

positioning the screen within the wellbore axially spaced apart from the formation;

stimulating the formation; and positioning the screen opposite the formation after the step of stimulating the formation.

17. The method according to claim 16, wherein the step of stimulating the formation is performed after the step of positioning the screen axially spaced apart from the formation.

18. The method according to claim 16, wherein the step of stimulating the formation includes forcing particulate matter into the formation, and further comprising the step of accumulating at least a portion of the particulate matter between the screen and the wellbore after the step of positioning the screen opposite the formation.

19. The method according to claim 16, wherein the step of positioning the screen axially spaced apart from the formation comprises attaching the screen to a first tubing string and disposing the first tubing string within the wellbore.

20. The method according to claim 19, wherein the step of positioning the screen opposite the formation comprises attaching the screen to a second tubing string, detaching the screen from the first tubing string, and displacing the second tubing string within the wellbore.

21. The method according to claim 16, wherein the step of positioning the screen axially spaced apart from the formation comprises disposing the screen proximate a bottom of the well.

22. The method according to claim 16, wherein the step of positioning the screen axially spaced apart from the formation further comprises disposing a protective barrier in the wellbore between the screen and the formation before the step of stimulating the formation.

23. A method of completing a subterranean well, the well having a wellbore intersecting a formation, the method comprising the steps of:

providing a screen assembly including a first packer and a generally tubular screen having opposite ends, the first packer being attached to one of the screen opposite ends;

disposing the screen assembly within the wellbore axially spaced apart from the formation;

installing a first tubing string into the wellbore; and attaching the screen assembly to the first tubing string after the step of disposing the screen assembly within the wellbore.

24. The method according to claim 23, further comprising the step of installing a second tubing string into the wellbore.

25. The method according to claim 24, wherein the step of installing a second tubing string is performed before the step of installing the first tubing string into the wellbore.

26. The method according to claim 25, wherein the step of installing the first tubing string comprises inserting the first tubing string into the second tubing string.

27. The method according to claim 24, further comprising the step of attaching the screen assembly to the second tubing string.

28. The method according to claim 27, wherein the step of attaching the screen assembly to the second tubing string is performed before the step of installing the second tubing string.

29. The method according to claim 23, wherein the step of providing a screen assembly further comprises providing the screen assembly including a second packer, the second packer being attached to the other of the screen opposite ends.

30. The method according to claim 29, further comprising the step of positioning the screen assembly opposite the formation, the first and second packers axially straddling the formation.

31. The method according to claim 30, further comprising the steps of setting the first and second packers in the wellbore, and flowing fluid and particulate material from the formation into the wellbore.

32. The method according to claim 31, further comprising the step of accumulating the particulate material between the screen and the formation after the step of setting the first and second packers and after the step of flowing fluid and particulate material from the formation into the wellbore.

33. A method of completing a subterranean well, the well having a wellbore intersecting a formation, the method comprising the steps of:

disposing a generally tubular screen within the wellbore axially spaced apart from the formation;

forcing fluid into the formation after the step of disposing the screen within the wellbore; and positioning the screen opposite the formation, thereby forming an annular space between the screen and the formation, after the step of forcing fluid into the formation.

34. The method according to claim 33, wherein the step of forcing fluid into the formation further comprises forcing particulate matter into the formation.

35. The method according to claim 34, wherein the step of forcing particulate matter into the formation comprises forcing proppant into fractures formed in the formation.

36. The method according to claim 35, further comprising the step of flowing the proppant from the formation into the annular space after the step of positioning the screen opposite the formation.

37. A method of deploying a screen in a subterranean well, the method comprising the steps of:

releasably attaching the screen to a first tubing string;

disposing the first tubing string within the well;

disposing a second tubing string within the well;

attaching the screen to the second tubing string; and releasing the screen from the first tubing string.

38. The method according to claim 37, wherein the step of disposing the second tubing string within the well is performed after the step of disposing the first tubing string within the well.

39. The method according to claim 38, wherein the step of disposing the second tubing string within the well is performed by inserting the second tubing string into the first tubing string.

40. The method according to claim 37, wherein the step of releasing the screen from the first tubing string is performed after the step of attaching the screen to the second tubing string.

41. The method according to claim 37, wherein the step of attaching the screen to the second tubing string comprises releasably attaching the screen to the second tubing string.

42. The method according to claim 41, further comprising the step of releasing the screen from the second tubing string.

43. The method according to claim 42, further comprising the step of removing the second tubing string from the well after the step of releasing the screen from the second tubing string.

44. Apparatus for attachment to a first tubing string within a subterranean well, the apparatus comprising:

a generally tubular screen having opposite ends;

a first packer attached to one of the screen opposite ends; and a first latch structure attached to the first packer, the first latch structure being capable of attachment to the first tubing string within the well, such that the screen is positionable within the well by displacement of the first tubing string.

45. The apparatus according to claim 44, further comprising a second latch structure, the second latch structure being attachable to the first tubing string and the second latch structure being releasably attachable to the first latch structure.

46. The apparatus according to claim 45, wherein the second latch structure sealingly engages the first latch structure when the first and second latch structures are attached to each other.

47. The apparatus according to claim 45, wherein the second latch structure displaces a member relative to the first latch structure when the first and second latch structures are attached to each other.

48. The apparatus according to claim 44, further comprising a second packer attached to the other of the screen opposite ends.

49. The apparatus according to claim 48, further comprising a generally tubular member axially slidingly received within the screen and first and second packers.

50. Apparatus for positioning equipment within a subterranean well, the apparatus comprising:

a screen assembly;

a first portion attached to the screen assembly; and a second portion complementarily shaped relative to the first portion, and the second portion being configured for operative engagement with the first portion to thereby permit displacement of the screen assembly within the well by displacement of the second portion.

51. The apparatus according to claim 50, wherein the first portion has a first, at least partially upwardly facing, shoulder formed thereon, and wherein the second portion has a second, at least partially downwardly facing shoulder formed thereon, the first and second shoulders axially contacting each other when the first portion is operatively engaged with the second portion.

52. The apparatus according to claim 50, wherein one of the first and second portions carries a circumferential seal, and wherein the other of the first and second portions has a seal bore formed thereon, the seal sealingly engaging the seal bore when the first portion is operatively engaged with the second portion.

53. The apparatus according to claim 50, wherein the screen assembly has a member extending at least partially into the first portion, and wherein the second portion displaces the member when the first portion is operatively engaged with the second portion.

54. Apparatus for positioning equipment within a subterranean well relative to first and second tubing strings disposed therein, the apparatus comprising:

a screen assembly:

a first portion attached to the screen assembly;

a second portion attachable to the first tubing string and releasably attachable to the first portion; and a third portion attachable to the second tubing string and attachable to the first portion.

55. The apparatus according to claim 54, wherein the third portion is releasably attachable to the first portion.

56. The apparatus according to claim 54, wherein the second portion is releasably attached to the first portion by a shear member installed into the first and second portions.

57. The apparatus according to claim 54, wherein the third portion is releasably attachable to the first portion by a series of latch members formed on one of the first and third portions.

58. The apparatus according to claim 57, wherein the latch members are threaded, and wherein the third portion is releasable from the first portion by unthreading the latch members from complementarily shaped threads formed on the other of the first and third portions.

* * * * *